US007931070B2

(12) United States Patent
Chino et al.

(10) Patent No.: US 7,931,070 B2
(45) Date of Patent: Apr. 26, 2011

(54) SLIDING SCREEN DOOR

(75) Inventors: Mitsuhiko Chino, Tokyo (JP); Hirotsugu Toda, Tokyo (JP); Masato Moriya, Tokyo (JP); Yoji Kamosawa, Tokyo (JP)

(73) Assignee: Seiki Hanbai Co., Ltd., Tokyo (JP)

( * ) Notice: Subject to any disclaimer, the term of this patent is extended or adjusted under 35 U.S.C. 154(b) by 229 days.

(21) Appl. No.: 10/576,261

(22) PCT Filed: Oct. 20, 2004

(86) PCT No.: PCT/JP2004/015517

§ 371 (c)(1),
(2), (4) Date: Apr. 17, 2006

(87) PCT Pub. No.: WO2005/038186

PCT Pub. Date: Apr. 28, 2005

(65) Prior Publication Data

US 2007/0068633 A1 Mar. 29, 2007

(30) Foreign Application Priority Data

Oct. 21, 2003 (JP) ..... 2003-361102
Mar. 17, 2004 (JP) ..... 2004-076814

(51) Int. Cl.

| | |
|---|---|
| ***E05D 15/06*** | (2006.01) |
| ***A47H 5/00*** | (2006.01) |
| ***E06B 3/48*** | (2006.01) |
| ***E06B 3/94*** | (2006.01) |
| ***E06B 9/06*** | (2006.01) |

(52) U.S. Cl. ..... 160/194; 160/84.06

(58) Field of Classification Search ..... 160/194, 160/201, 240, 242, 243, 245, 264, 268.1, 160/271, 272, 277, 279, 31, 84.04, 84.05, 84.06

See application file for complete search history.

(56) References Cited

U.S. PATENT DOCUMENTS 5,775,814 A * 7/1998 Agari ..... 384/45
6,318,438 B1 * 11/2001 Uno et al. ..... 160/31
6,978,820 B2 * 12/2005 Aoki ..... 160/84.06

FOREIGN PATENT DOCUMENTS

| | | |
|---|---|---|
| JP | 7-173979 | 7/1995 |
| JP | 7-229377 | 8/1995 |
| JP | 2895766 | 5/1999 |
| JP | 3417685 | 6/2003 |
| JP | 2003-201796 | 7/2003 |
| JP | 2004-346578 | 12/2004 |
| WO | WO 2004104357 A1 * | 12/2004 |

* cited by examiner

*Primary Examiner* — Katherine W Mitchell
*Assistant Examiner* — Jeremy C Ramsey
(74) *Attorney, Agent, or Firm* — Oblon, Spivak, McClelland, Maier & Neustadt, L.L.P.

(57) ABSTRACT

In a sliding screen door in which a net is formed to be capable of expansion and contraction, and is formed to be capable of freely opening and closing by horizontal pulling, a net guide forms the net guide into a straight line shape in a condition of being led out from a frame member, and a movement of a net-holding member that follow the net guide is made smooth, and many of the guiding elements form the net guide for guiding the lower end of the net and include an approximately u-shape composed of a bottom portion and rising wall portions, and are formed into a series of guide rails that are serially in contact with each other by means of rising wall portions of the adjoining guiding elements, and a net-holding member which is engaged with the guide rails so as to be movable along the guide rail.

5 Claims, 11 Drawing Sheets

SLIDING SCREEN DOOR

TECHNICAL FIELD

The present invention relates to a sliding screen door capable of freely opening and closing by horizontally pulling a net capable of expansion and contraction by means of alternately folding back the net in a reverse direction, and more concretely, to a sliding screen door in which the net or a string being inserted therethrough is held by a net guide for guiding a lower end or an upper and lower ends of the aforementioned net.

BACKGROUND ART

As for a screen door capable of freely opening and closing by horizontally pulling a net capable of expansion and contraction by means of alternately folding the net in a reverse direction, which is provided with a net guide that moves into inside of a lower end of a frame member attached to both ends of the net and moves out from the lower end in response to open-and-close movement of the net, and that guides a lower end of the net, while being led out along the lower end of the net being in a stretched condition, and that prevents the net from swinging, a sliding screen door disclosed in the Patent Document 1 is known, for example. This already proposed screen door is extremely effective in terms of that a barrier-free net guide can be provided with simple structure and at low cost.

In this kind of sliding screen door, even when the lower end portion of the net is held by means of the net guide, the net is sometimes curved or disengaged from the net guide when accepting a strong wind. Accordingly, although it is desirable for the net guide to hold the net, it is required that not only the net-holding member for holding the net is constructed to be capable of moving together with the net in an opening and closing direction of the net, but also the net and the net-holding member are constructed to be capable of relative movement.

Patent Document 1: Japanese Unexamined Patent Application Publication No. 2000-234483

DISCLOSURE OF INVENTION

Problems to be Solved by the Invention

A technical problem of the present invention is to movably engage a net-holding member with a net guide that guides a lower end or an upper and lower ends of the aforementioned net in a sliding screen door capable of freely opening and closing by means of horizontally pulling the net capable of expansion and contraction by means of alternately folding back the net in a reverse direction.

More in concrete, a technical problem of the present invention is to provide a sliding screen door capable of forming a net guide that guides the aforementioned net into a straight line like rail-shape in a leading out condition from a frame member, and causing the movement of the net-holding member that follows the net guide to be smooth, and suppressing the disengagement of the net from the net guide.

Another technical problem of the present invention is to provide a sliding screen door capable of suppressing a rough movement of the net-holding member when the net is in open-and-close operation, in a case that the net-holding member slants leftward or rightward in response to the open-and-close movement of the net, in a case when a stretching string inserted into an end portion of the net is held by means of the net-holding member.

Means for Solving the Problems

To solve the above-described problems, the present invention is characterized in that a sliding screen door includes a net being alternately folded back in a reverse direction at folding lines being in parallel to each other, configured to be capable of expansion and contraction by means of being folded back at the folding lines, and configured to be capable of open-and-close movement by horizontal pulling, and a net guide moving out from and into an interior of at least one end of a frame member attached to both ends in an open-and-close direction of the net in response to the open-and-close movement of the net, and guiding an upper and lower end or one end of the net, in which the aforementioned net guide is configured to mutually and flexibly connect many of guiding elements formed of an approximately U-shape composed of a bottom portion following an end portion of the aforementioned net and rising wall portions following an outside face of the net by means of inserting a series of wire member into a through hole following a tip end portion of the rising wall portion, and to form a series of guide rail, in which the net guides are serially in contact with each other at the rising wall portions of the adjoining guiding elements, when the net guide is led out along the end portion of the net being stretched, and in which a net-holding member being engaged with the guide rail of the net guide in a manner so as to be movable along the guide rail for suppressing the end portion of the net to be disengaged from the net guide by directly or indirectly holding the end portion of the net is provided in the guide rail of the net guide.

In the preferred embodiment of the sliding screen door according to the present invention, a guide rail can be formed of a series of concave grooves being serially in contact with each other between the adjoining guiding elements at each of an outer face and an inner face of the rising wall portion of the net guide, or a series of tip end expansion portions to be serially in contact with each other between the adjoining guiding elements can be formed at a tip end of the rising wall portion of the net guide, and a guide rail is thereby formed, or a series of groove-shaped guide rail being mutually connected between the adjoining guiding elements can be formed at an inside face of the rising wall portion of the net guide. The net-holding member is engaged with the engaging portion to be movable along the guide rail by means of engaging the engaging portion formed in the aforementioned net-holding member with these guide rails. In this case, the aforementioned net-holding member can be engaged with the net guide in a manner so as to be rotatable in response to a direction of the net keeping a vertical posture.

In another preferred embodiment of the sliding screen door according to the present invention, a stretching string constituting a parallel movement mechanism for moving a movable doorframe provided for open-and-close operation for the net in parallel is inserted into the net and stretched between the frame members constituting the sliding screen door, and the net-holding member provided in the net guide is configured to have a hooking hole for hooking the stretching string, and the lower end of the net is indirectly held by hooking the stretching string stretched at a lower part between the aforementioned frame members with the hooking hole. In this case, it is preferable that the hooking hole for inserting the stretching string in the net-holding member includes a slit reaching an outer edge of the net-holding member, and the aforementioned stretching string is hooked to the aforementioned hooking hole through the slit. Accordingly, it becomes capable of easily detaching and attaching the net-holding member even when the screen door is assembled or is in the installed condition.

Further, the lower end of the net can be also directly held by means of sandwiching the lower end portion of the aforementioned net by the net-holding members provided in the aforementioned net guide.

Furthermore, in the preferred embodiment of the sliding screen door according to the present invention, the aforementioned net-holding member includes two sheets of stretching string hooking pieces being rotatably connected at a hinge portion vertically disposed along a folding line of the aforementioned net, which open and close in a manner so as to follow plane portions of both sides of the folding line along with expansion and contraction of the net, and a hooking hole for inserting the stretching string is formed at each of the stretching string hooking pieces in the net-holding member, and an engaging-and-supporting leg for movably engaging the stretching string hooking pieces with the net guide is formed in the net-holding member, and a posture of the net-holding member is kept under restraint by means of at least three points, including the stretching string being inserted into the hooking hole in each of the stretching string hooking pieces, and the net guide being engaged with the engaging-and-supporting leg. Accordingly, the net-holding member is configured to have independence.

The hinge portion of the net-holding member is constructed by means of integrally forming a connecting portion of the two sheets of stretching string hooking pieces formed of synthetic resin to the engaging-and-supporting leg being movably engaged with the net guide by thin-walled portion of the synthetic resin in a rotatable manner, or providing a rotating shaft portion at each of the connecting portions of the two sheets of the stretching string hooking pieces, and a rotatably supporting portion for rotatably supporting the rotating shaft portion provided at the engaging-and-supporting leg movably engaged with the net guide, and rotatably supporting the rotating shaft portion by the rotatably supporting portion.

In addition, the hinge portion of the net-holding member is constructed by means of rotatably and integrally forming the connecting portions of the two sheets of stretching string hooking pieces formed of synthetic resin by means of thin-walled portion formed of synthetic resin, and the engaging-and-supporting leg being movably engaged with the net guide can be provided at facing edge side opposite to the hinge portion of each of the stretching string hooking pieces.

In these net-holding members, it is preferable that the hooking hole for inserting the stretching string at the two sheets of stretching string hooking pieces respectively includes a slit reaching an outer edge of each of the stretching string hooking pieces, and the stretching string is hooked to the hooking hole through the slit. Accordingly, it becomes capable of easily detaching and attaching the net-holding member even when the screen door is assembled or is in the installed condition.

In the sliding screen door having the above-described construction according to the present invention, since the net guide is constructed to be bent in a manner so as to become concave upward by means of serially connecting the tip end portions of the rising wall portion of the guiding element constituting the aforementioned net guide, not only the net guide, whose one end is moved out from and into the frame member, is able to be provided in a simple construction at low cost, but also the maintenance capability can be improved. In addition, a series of guide rail can be formed by means of rising wall portions of the adjoining guiding elements, when the net guide is led out along the end portion of the net, and the aforementioned net-holding member can be movably disposed along the guide rail. Accordingly, the aforementioned net-holding member can be stably moved along the net guide.

Further, in a case when a plate-shaped simple material is used to serve as the aforementioned net-holding member, since the material is not provided with the independency, the net-holding member may slant either leftward or rightward in response to the open-and-close movement of the net and therefore, the net-holding member does not smoothly move along the net guide when the net is opened or closed and there is a possibility that the open-and-close movement of the net becomes rough. However, when the net-holding member having the aforementioned two sheets of the stretching string hooking pieces is used, the posture of the net-holding member is kept under restraint by at least three points. In other words, the hooking-and-supporting leg of the net-holding member is kept under restraint by the net guide, and each of the stretching string hooking pieces is kept under restraint by means of the stretching string that is inserted into the hooking hole thereof. Therefore, the net-supporting member is suppressed to be slanted leftward or right ward in response to the open-and-close movement of the net and becomes capable of smoothly moving along the net guide.

Advantages

According to the sliding screen door of the present invention having the aforementioned construction, in the sliding screen door capable of freely opening and closing by means of horizontally pulling the net capable of expansion and contraction by means of alternately folding back in a reverse direction, a net guide that guides the aforementioned net can be formed of a straight line like rail-shape in a leading out condition from a frame member, and thereby the movement of the net-holding member that follows the net guide can be caused to be smooth by means of forming a guide rail in the net guide and movably engaging the net-holding member therewith.

REFERENCE NUMERALS

Figure 1:
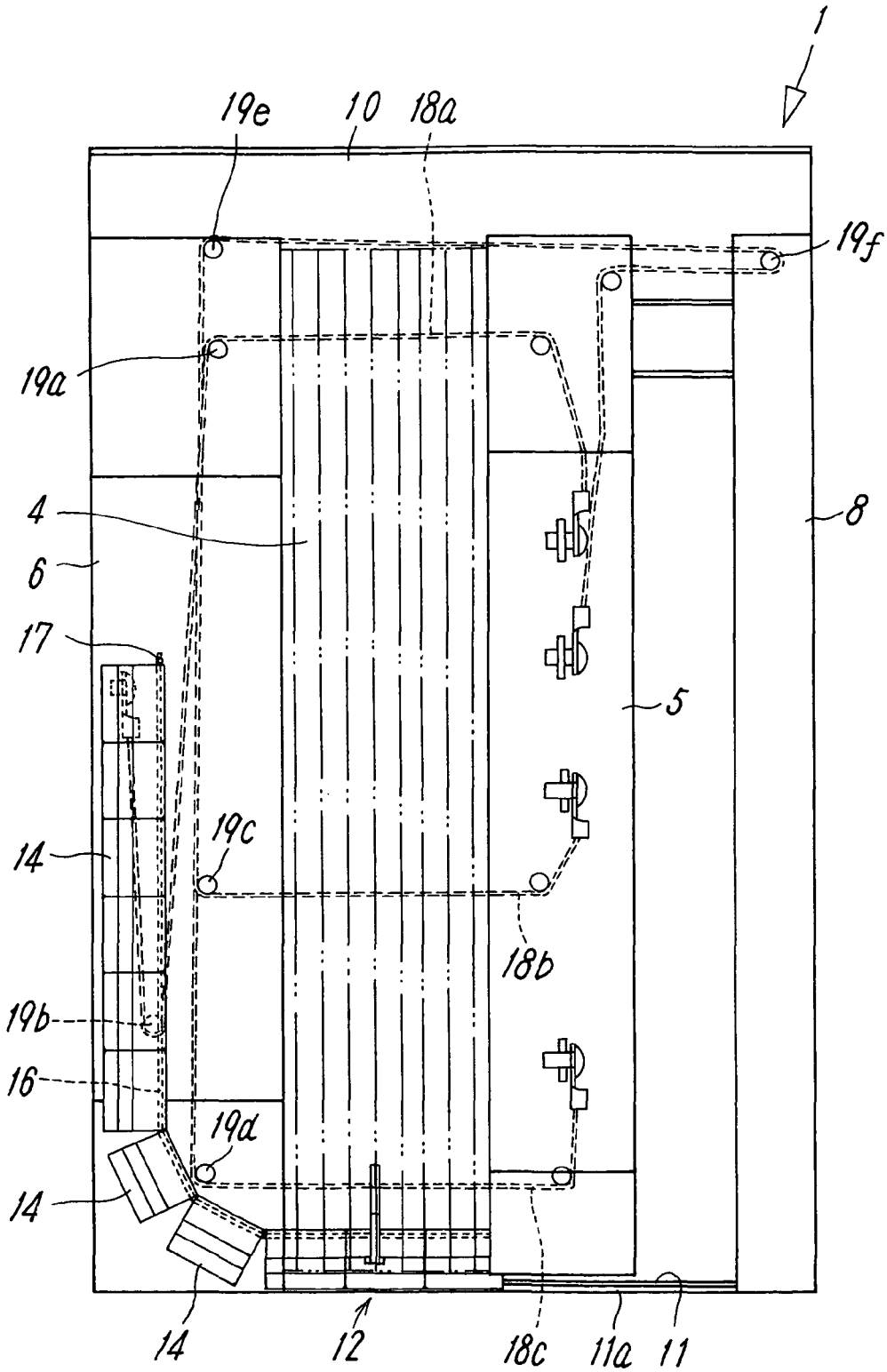
FIG. 1 is a constructional elevation showing an entire structure of the first embodiment of a sliding screen door with respect to the present invention.

1: screen door frame
4: net
5: movable doorframe
6 and 8: vertical frame member
12: net guide
12A through 12C: guide rail
13A and 13B: net guide
14: guiding element
14*a*: bottom portion
14*b*: rising wall portion
14*c*: through hole
14*f*: outside concave groove
14*g*: inside concave groove
14*i*: tip-end expanded portion
16: wire member
18*a* through 18*c*: stretching string
20, 30, 40, 50, 60, 70, 80, and 90: net-holding member
22*a*, 42*a*, 52*a*, 62*a*, 72*a*, and 82*a*: hooking hole
22*b*, 42*b*, 52*b*, 62*b*, 72*b* and 82*b*: slit
22*c*, 23*b*, 32*c*, and 33*b*: engaging portion
23, 33, 63, 73, and 83: engaging-and-supporting leg
61, 71, and 81: hinge portion
62, 72, and 82: stretching string hooking piece

BEST MODE FOR CARRYING OUT THE INVENTION

Figure 2:
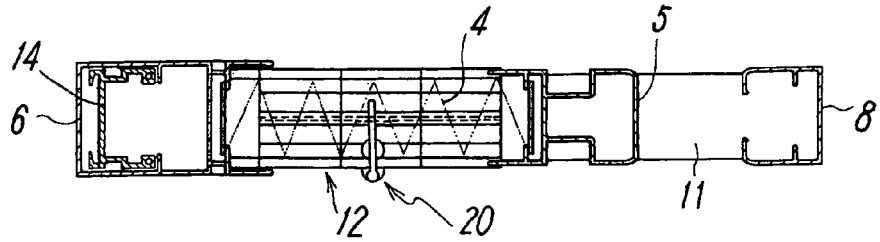
FIG. 2 is a cross-sectional plan view showing the same.
Figure 3:
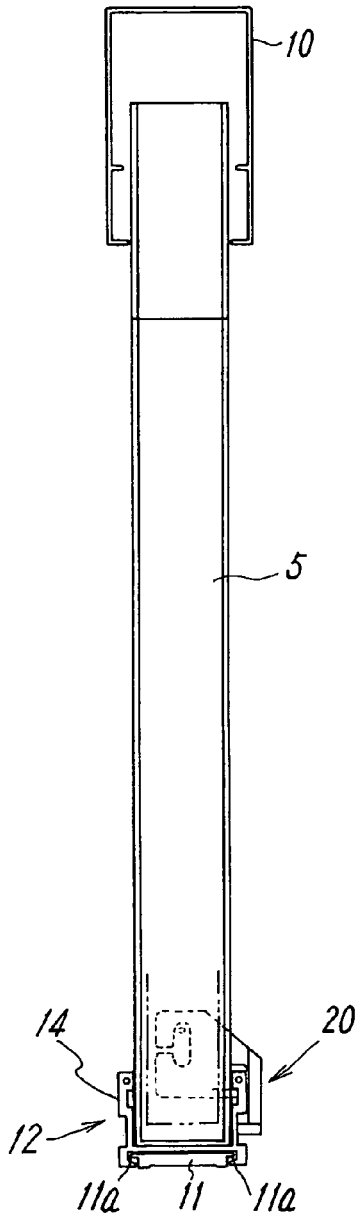
FIG. 3 is a cross-sectional side elevation showing the same.

FIGS. 1 through 3 illustrate an entire structure of a sliding screen door according to the first embodiment of the present invention.

The sliding screen door is, schematically, provided with a screen door frame 1 attached to an opening portion of a building, a net 4 for protection from insects attached in the screen door frame 1 in a manner so as to be movable by means of horizontal pulling, and a movable doorframe 5 for operation for opening and closing, which is attached to one end of the net 4. The aforementioned screen door frame 1 includes left and right vertical frame members, 6 and 8, and a horizontal frame member 10 located at an upper part. At a lower part of the screen door frame 1, substantially, a fixed frame member is not provided whereas only a low guide plate 11 (Refer to FIG. 2.) having a height to such an extent that a net guide 12, described later, is guided (about 3 mm) is provided intending to a barrier-free construction, accordingly.

The aforementioned net 4 is configured such that one end thereof is fixed to the aforementioned movable doorframe 5 and the other end thereof is fixed to a vertical frame member 6 of the aforementioned screen door frame 1. The aforementioned net guide 12 for guiding a lower end portion of the net 4 is configured such that, one end thereof is attached to the lower end of the movable doorframe 5 and that the other end thereof makes frequent appearances from the vertical frame member 6 along with a movement of the movable doorframe 5. As described above, when the net 4 is in a stretched condition, the net guide 12 supports the end portion of the net by means of being led out along a lower end of the net 4.

In addition, in order to stably move the aforementioned movable doorframe 5 for parallel movement, a parallel movement mechanism is installed in the movable doorframe 5. The parallel movement mechanism is, in the screen door of the present embodiment, configured by stretching three stretching strings, 18*a* through 18*c*, described later, between the screen door frame 1 and the movable doorframe 5.

In more concrete explanation, the aforementioned net guide 12 is configured to guide the lower end portion of the net at a time of open-and-close movement of the net 4, and is constructed by means of flexibly connecting numbers of guiding elements 14 formed of synthetic resin by wire members 16 having flexibility.

Figure 4:
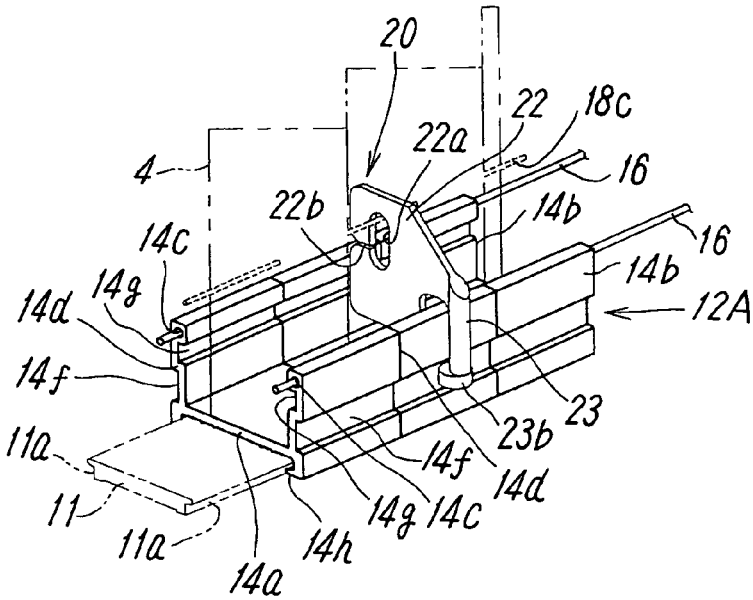
FIG. 4 is a perspective view of a main part showing a mode of using a net-holding member in the aforementioned first embodiment.
Figure 5:
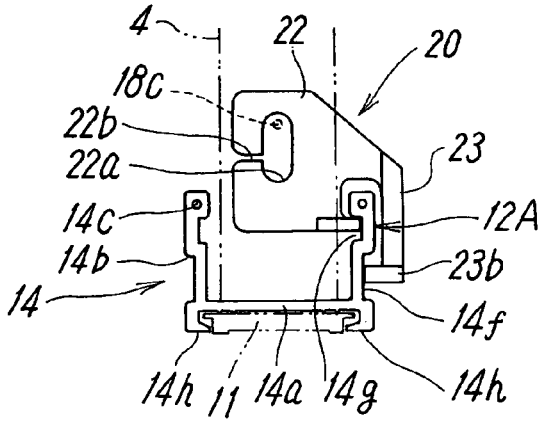
FIG. 5 is a side elevation showing the main part of the same.

The guiding element 14 that constitutes the aforementioned net guide 12 is, as clearly shown in FIGS. 4 and 5, formed of approximately U-shape composed of a bottom portion 14*a* that follows the lower end of the net 4 and rising wall portions 14*b* rising along outer surfaces of the net 4 and is made of synthetic resin. Through holes 14*c* for the wire members 16 to be inserted are formed along tip end portions of the rising wall portions 14*b* (opening side end portion) in the guiding element 14, and by means of inserting the aforementioned wire members 16 into each of the through holes 14*c* of the guiding element 14, each of the guiding elements 14 is flexibly connected together at the tip end portions of the rising wall portions 14*b* in a manner so as to become concave upward. The net guide 12 is configured such that, at an outside end of the guiding element 14 to serve as an end portion of the net guide 12, a stopper 17 (Refer to FIG. 1.) is provided (The other end is not shown.) at an end portion of the wire member 16 and thereby each of the guiding elements 14 is prevented from being disengaged from the wire member 16. In addition, many of these guiding elements 14 are serially contacted in a straight line like manner by means of being in contact with end portions of the serial contacting faces 14*d* of the bottom portion 14*a* and the rising wall portions 14*b* of the guiding element 14 each other.

Figure 12:
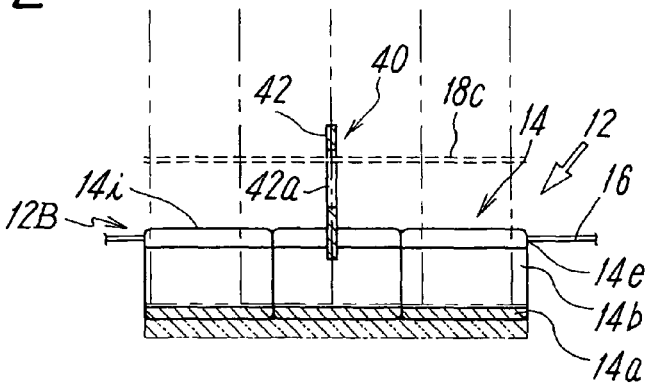
FIG. 12 is a partial cross-sectional elevation showing the same.
Figure 14:
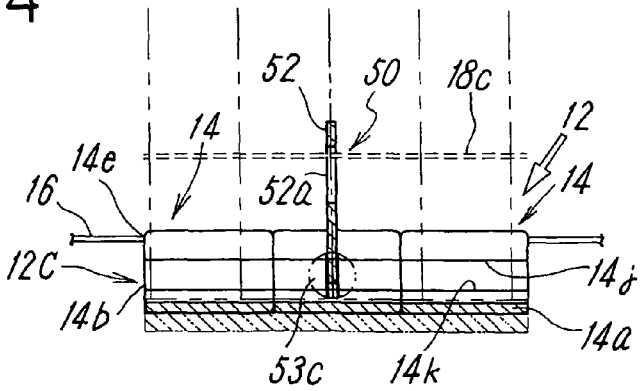
FIG. 14 is a partial cross-sectional elevation showing the same.
Figure 15:
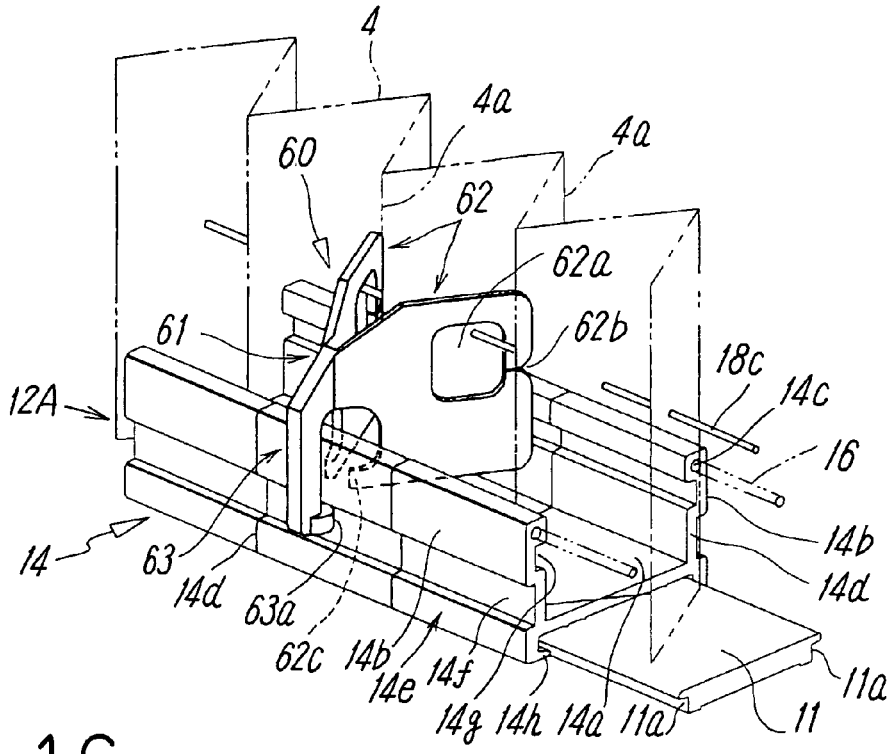
FIG. 15 is a perspective view of a main part showing the fifth embodiment.
Figure 16:
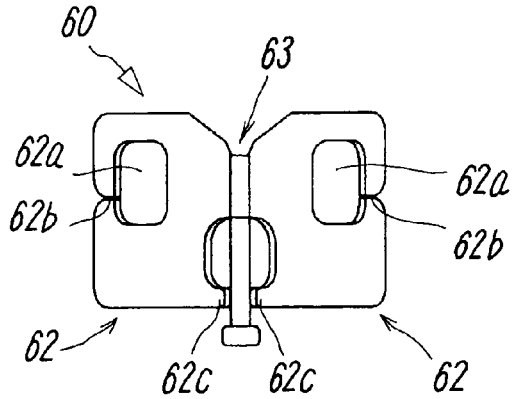
FIG. 16 is an elevation showing a net-holding member in the same embodiment.
Figure 17:
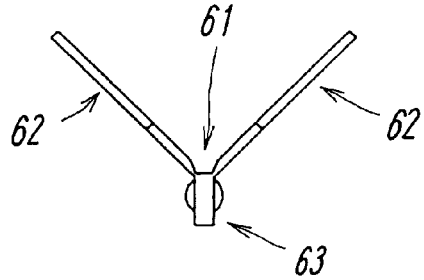
FIG. 17 is a plan view showing a net-holding member in the same embodiment.
Figure 18:
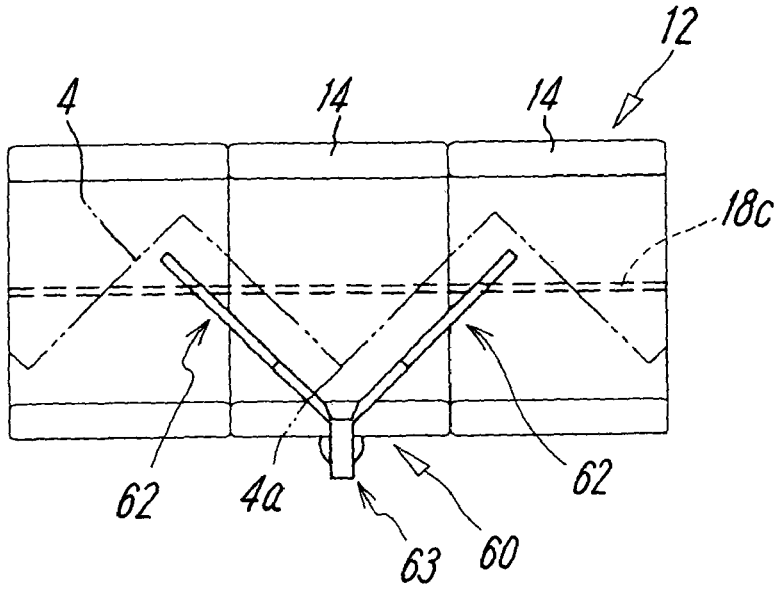
FIG. 18 is a plan view showing a condition of a net-holding member when the net is developed and stretched in the same embodiment.

Incidentally, at the tip end of the rising wall portion 14*b* of each of the guiding elements 14, a slight chamfering portion 14*e* at which the tip end portions of the rising wall portion 14*b* of the adjoining guiding elements 14 come in contact with each other when the net guide 12 is caused to have a flexion is formed (FIGS. 12 and 14). Thereby, the flexion of the aforementioned net guide 12 can be made smooth.

Further, outside concave grooves 14*f* and inside concave grooves 14*g* are formed in the rising wall portions 14*b* of each of the guiding elements 14 for movably engaging an engaging-and-supporting leg 23 of the net-holding member 20, described later, with the net guide so that a series of guide rails 12A for movably engaging the engaging-and-supporting leg 23 is formed when the net guide 12 is constructed by serially connecting each of the guiding elements 14. In concrete explanation, the guide rail 12A is composed of the outside concave groove 14*f* that opens toward an outer face of a lower portion of the rising wall portion 14*b* of the guiding element 14 and the inside concave groove 14*g* that opens toward an inner face of an upper portion of the rising wall portion 14*b*, and thereby a serial concave groove is formed by means of serial connection of the guiding elements 14. In the embodiment shown in the figure, although the aforementioned guide rail 12A is provided at both side of the rising wall portions 14*b*, it is sufficient that the guide rail 12A is provided at least one of the rising wall portions 14*b*.

Further, inwardly facing hook-like portions 14*h* are provided at both sides of the lower face of the guiding elements 14. This is to guide the movement of the net guide 12 by means of engaging with a concave portion 11*a* of both sides of the guide plate 11 mounted on a floor surface, and for uplift prevention for the net guide 12 from the floor surface.

Since the net guide 12 having the aforementioned construction is configured such that the net guide 12 is upwardly bent by means of causing the serial contacting face 14*d* of the guiding element 14 that constitutes the net guide 12 to be serially in contact with each other, the net guide can be not only provided with a simple construction at lower cost, but also stably operated, while the capability of maintenance can be improved. In addition, when the net guide 12 is led out along the end portion of the net 4, the serial contacting face 14*d* of each of the adjoining guiding elements 14 is configured to be serially in contact with each other, and thereby the net 4 is prevented from curving in a horizontal direction and the end portion of the aforementioned net 4 can be always stably guided.

In addition, since the aforementioned net guide 12 can be formed of a series of guide rails 12A being serially in contact with each other between the adjoining guiding elements 14 at the rising wall portion 14*b* when the net guide 12 is led out along the lower end portion of the net 4 in a stretched condition, the holding member 20 for the net 4 can be movably disposed along the guide rail 12A and the movement of the holding member 20 along the guide rails 12A can be caused to become smooth.

Further, in the first embodiment shown in FIGS. 1 through 3, the one end of the aforementioned net guide 12 is fixed to the lower end of the movable doorframe 5 and the other end thereof is inserted with flexion into the vertical frame member 6 from the lower end of the vertical frame member 6 in manner so as to freely make frequent appearance. However, the net guide 12 can be also configured such that one end thereof is fixed to the lower end of the vertical frame member 6 and that the other end thereof can be inserted into inner part of the movable doorframe 5 from the lower end thereof. Alternatively, by stretching the net 4 between two movable doorframes being positioned between a pair of vertical frame members, 6 and 8, the net guide that follows the end portion of the net can be also moved in and out from the lower end of one or both of the movable doorframes, which can be deemed to be common with the vertical frame members, into the inner part of the movable doorframe(s).

On the other hand, the aforementioned net 4 is formed by alternately folding back the net in a reverse direction at numbers of folding lines 4*a* being in parallel with each other, is configured to be free for expansion and contraction by being folded back at the folding lines 4*a* in a style of an accordion. Further, the net 4 is configured to be capable of open-and-close movement by means of moving the movable doorframe 5 attached to one end of the net 4, in a left and right direction.

Further, as the parallel movement mechanism for stably moving the aforementioned movable door frame 5 for parallel movement, a first through third stretching strings, 18*a* through 18*c*, are stretched among the screen door frame 1, the movable doorframe 5, the end portion of the net guide 12, and the like, as shown in FIG. 1.

One end of the aforementioned first stretching string 18*a* is attached to an upper end of the aforementioned movable doorframe 5. The first stretching string 18*a* is led into the vertical frame member 6 after penetrating through the net 4, and then downwardly led in the vertical frame member 6 by means of a turnaround element 19*a*. Thereafter, the first stretching string 18*a* is entrained about a turnaround element 19*b* formed at a lower part of the vertical frame member 6 and thereby upwardly led in the vertical frame member 6 and the tip end of the first stretching string 18*a* is connected to the guiding element 14 positioned at the tip end of the net guide 12 that is led out and in the vertical frame member 6.

On the other hand, the second and third stretching strings, 18*b* and 18*c*, each of one ends of which is attached to a center and a lower end portions of the aforementioned movable doorframe 5, are respectively penetrated through the net 4 and led into the vertical frame member 6. Thereafter, the second and third stretching strings, 18*b* and 18*c*, are turned by means of turnaround elements, 19*c* and 19*d*, and led into the horizontal frame member 10 at an upper part, after passing through the vertical frame member 6, and further, those stretching strings, 18*b* and 18*c*, are led to an upper end of the vertical frame member 8 after passing through the horizontal frame member 10 by means of a turnaround element 19*e*. In addition, the stretching strings, 18*b* and 18*c*, are led through the aforementioned horizontal frame member 10 in a reverse direction after being entrained about a turnaround element 19*f* provided at an upper part of the vertical frame member 8, and led into the aforementioned movable doorframe 5. The tip ends of the same are connected to the movable door frame 5.

By stretching such stretching strings, 18*a* through 18*c*, even when whatever part of the movable doorframe 5 in upper and lower directions is pressed for the open-and-close operation for the net, the movable doorframe 5 can be always moved in parallel movement by means of the function of the stretching strings.

At a part where the above-described stretching strings, 18*a* through 18*c*, are stretched in a horizontal direction in the net 4 in which the stretching strings, 18*a* through 18*c*, are in the developed and stretched condition, the net 4 is prevented from being loosened by means of inserting those stretching strings, 18*a* and 18*b*, in the net 4, and the stretched condition of the net can be made stable. Specifically, since the stretching string 18*c* inserted into a guide end portion located at the net guide 12 of the lower end of the net 4 is hooked by means of the net-holding member 20, the net is indirectly held by means of the net-holding member 20 via the stretching string 18*c*, and even when relatively strong outer force, such as a wind or the like is applied to the net 4, the net 4 is securely prevented from being disengaged from the net guide 12.

Further, as for the aforementioned each of the turnaround elements, 19*a* through 19*f*, a sliding member made of synthetic resin having small resistance with the stretching strings, 18*a* through 18*c*, or a pulley or the like can be employed.

In the aforementioned embodiment, a case in which three stretching strings, 18*a* through 18*c*, constituting the parallel movement mechanism of the movable doorframe 5 are stretched in a certain mode, as the stretching strings for inserting into the net 4, is explained. However, as long as those are a plurality of stretching strings or those capable of constituting the parallel movement mechanism together with the net guide 12, it is not limited to the stretching mode in the drawings. Further, the stretching string 18*c* held by the net-holding member 20, explained below is not limited to the stretching string which constitutes the aforementioned parallel movement mechanism. For example, a stretching string or the like for applying tension force in a direction to fold back the net 4 in the aforementioned movable doorframe 5, such as a spring can be utilized.

Further, as the aforementioned wire member 16 to be inserted into the guiding element 14 that constitutes the net guide 12, an extending part of the stretching string that constitutes the parallel movement mechanism of the aforementioned movable doorframe 5 can be also utilized.

Next, the net-holding member 20 in the aforementioned first embodiment will be explained referring to FIGS. 4 and 5.

The net-holding member 20 is provided with the engaging-and-supporting leg 23 at a side end of a main body portion 22, which droops by the side of an outer face of the rising wall portion 14*b* of the aforementioned guiding element 14, and an elongated hooking hole 22*a* for hooking the aforementioned third stretching string 18*c* being inserted in the net 4 is provided in the main body portion 22. By means of providing a slit 22*b* at one side of the hooking hole 22*a*, the aforementioned stretching string 18*c* is configured to be capable of being hooked in the hooking hole 22*a* therethrough. In addition, at a lower end of the aforementioned engaging-and-supporting leg 23, a disc-shaped engaging portion 23*b* that is engaged with the aforementioned concave groove 14*f* is provided, and at a lower part of the main body portion 22, a disc-shaped engaging portion 22*c* similar to the aforementioned engaging portion 23*b* that is engaged with the aforementioned concave groove 14*g* is provided.

Accordingly, when the net-holding member 20 is mounted on the rising wall portion 14*b* while engaging the engaging portions, 23*b* and 23*c*, of the net-holding member 20 with both the concave grooves, 14*f* and 14*g*, of the guiding elements 14, respectively, the net-holding member 20 is movable along the guide rail 12A and at the same time, the main body portion 22 becomes rotatable around the engaging-and-supporting leg 23 to some extent remaining in a vertical posture.

In addition, in FIGS. 1 and 2, a case in which a single net-holding member 20 is attached to the net guide is illustrated, however, the net-holding member is not necessary to be single, and a plurality of the net-holding member can be provided in the net guide 12A at a proper interval.

In the aforementioned first embodiment, although the stretching string 18*c* inserted into the net 4 is held by means of the net-holding member 20 and thereby the net is configured to be indirectly held, the net can be also directly held by means of the net-holding member.

The second embodiment, shown in FIGS. 6 through 10, is configured such that the net 4 is directly held by means of a net-holding member 30. The net-holding member 30 that is formed to be movable along the guide rail 12A of the net guide 12 similar to that in the aforementioned first embodiment is composed of a holding member main body 32 (FIGS. 7 and 8) that constitutes a member of one of sandwiching devices for the net 4, and a sandwiching piece 34 (FIG. 9) to be detachably joined with the holding member main body 32 sandwiching the net 4 therebetween.

Incidentally, in a case of the second embodiment, as for the net guide 12, the same element as that in the aforementioned first embodiment is used, and the guiding element 14 that constitutes the net guide 12 is also the same. Accordingly, in FIG. 10, the same parts as that in the aforementioned first embodiment are denoted by the same numerals.

Further, including the hereinafter explained embodiment, a basic configuration as a screen door, such as a screen door frame 1, the net 4, the movable element 5, the parallel movement mechanism, and the like is substantially the same as that explained referring to FIGS. 1 through 3 in the first embodiment, therefore, explanation for those is omitted hereinafter.

The aforementioned net-holding member 30 is provided with an engaging-and-supporting leg 33 at a side end of a holding member main body 32, which droops by the side of an outer face of the rising wall portion 14*b* of the aforementioned guiding element 14, and at a lower end of the aforementioned engaging-and-supporting leg 33, a disc-shaped engaging portion 33*b* that is engaged with the aforementioned concave groove 14*f* is provided, and at a lower part of the holding member main body 32, a disc-shaped engaging portion 32*c* to be engaged with the aforementioned concave groove 14*g* is provided.

Figure 6:
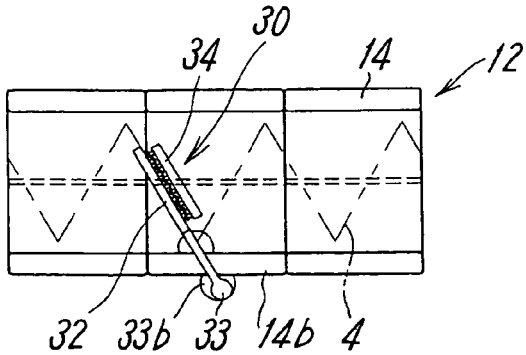
FIG. 6 is a plan view of a main part showing a mode of using a net-holding member in the second embodiment.
Figure 7:
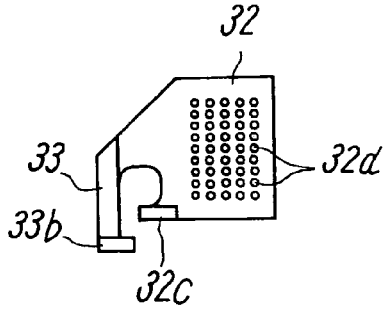
FIG. 7 is an elevation showing a main body of a holding member of the net-holding member in the same.
Figure 8:
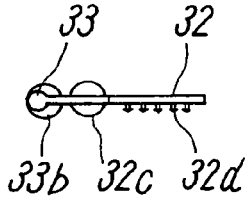
FIG. 8 is a plan view showing the same.
Figure 9:
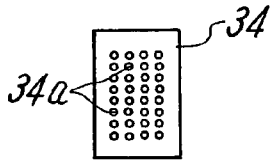
FIG. 9 is an elevation showing a sandwiching piece for sandwiching a net between the aforementioned main body of the holding member and the same.
Figure 10:
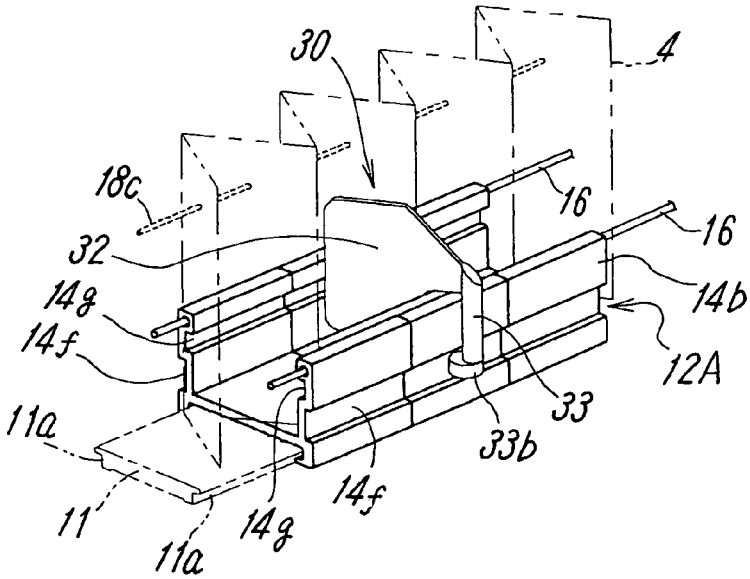
FIG. 10 is a perspective view showing a state of using the aforementioned net-holding member.

Accordingly, when the net-holding member 30 is mounted on the rising wall portion 14*b* while engaging the engaging portions, 33*b* and 33*c*, with both the concave grooves, 14*f* and 14*g*, respectively, the net-holding member 30 is movable along the guide rail 12A and at the same time, as shown in FIG. 6, the net-holding member 30 becomes rotatable around the engaging-and-supporting leg 23 to some extent remaining in a vertical posture in response to a direction of the net held by means of the aforementioned sandwiching device.

The aforementioned net-holding member 30 has numbers of mushroom-shaped projections, 32*d* and 34*a*, projected on each of the facing surfaces of the holding member main body 32, which is one of members that constitute the sandwiching device, and the sandwiching piece 34 to be detachably joined with the holding member main body 32 over the net 4. The numbers of mushroom-shaped projections are joined each other through meshes in a plane portion between the folded portions of the aforementioned net 4. By means of using such a sandwiching device, the net 4 is sandwiched by the net-holding member 30, and the net 4 is directly held by means of the net-holding member 30.

Incidentally, although a case is explained here, in which numbers of mushroom-shaped projections, 32*d* and 34*a*, that are joined each other through meshes of the net 4 are projected on each of the facing surfaces of the holding member main body 32 and the sandwiching piece 34, an appropriate sandwiching device, such as a face fastener or the like that can be joined through the aforementioned meshes can be employed.

Figure 11:
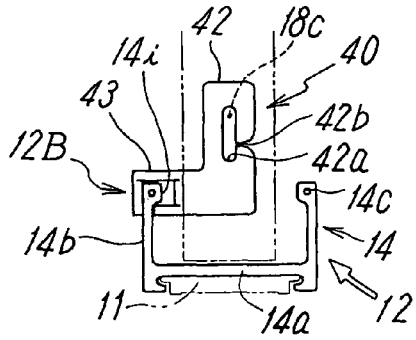
FIG. 11 is a partial side elevation showing a main part of the third embodiment.

The third embodiment, shown in FIGS. 11 and 12, is configured such that a tip end expansion portion 14*i* of the rising wall portion 14*b* of each of the guiding elements 14 that constitute the net guide 12 serves as a guide rail 12B as it is, and that the net-holding member 40 can be moved along the tip end expansion portion 14*i*. That is, a through hole 14*c* for inserting the wire member 16 is formed in the tip end expansion portion 14*i* of the aforementioned rising wall portion 14*b*, and a slightly widened part at a periphery of the through hole 14*c* serves as the guide rail 12B.

On the other hand, as clearly shown in FIG. 11, in the aforementioned net-holding member 40, one side of a flat plate-shaped main body portion 42 is extended in a horizontal direction, and an engaging portion 43 that engages with the guide rail 12B, which is formed of the tip end expansion portion 14*i* of the rising wall portion 14*b* of the aforementioned guiding elements 14, in manner so as to hold the guide rail 12B. By means of this engagement, the net-holding member 40 can be slid along the guide rail 12B.

Further, the aforementioned main body portion 42 is configured such that an elongated hole-shaped hooking hole 42*a* for hooking the aforementioned third stretching string 18*c* being inserted through the net 4 is formed in the main body portion 42, and that a slit 42*b* is formed at one side of the hooking hole 42*a* thereby hooking the aforementioned stretching string 18*c* in the hooking hole 42*a* therethrough.

Figure 13:
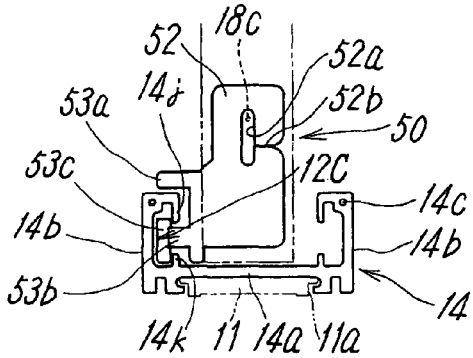
FIG. 13 is a partial side elevation showing a main part of the fourth embodiment.

Next, the fourth embodiment, shown in FIGS. 13 and 14 is configured such that a guide rail 12C is formed at an inner wall of the rising wall portion 14*b* of each of the guiding elements 14 that constitute the net guide 12, and that the net-holding member 50 can be moved along the guide rail 12C.

In other word, a groove-shaped guide rail 12C is formed by forming a drooping down wall 14*j* at an inner wall of the aforementioned rising wall portion 14*b* by means of horizontally extending inward from the tip end and bending downward in a manner so as to for an approximately hook-shape, and by forming a projecting ridge 14*k* upwardly rising from a portion facing the drooping down wall 14*j* on the bottom portion 14*a* of the guiding element 14. On the other hand, the aforementioned net-holding member 50 is configured such that a hooking hand 53*a* is extended from one side of a center portion of a main body portion 52, to be positioned above the rising wall portion 14*b* of the aforementioned guiding element 14, and that a hooking hand 53*b* is extended from one side of the base end portion thereof in parallel with the hooking hand 53*a*, and that a hooking portion 53*c* engaging between the aforementioned drooping down wall 14*j* that constitutes the aforementioned guide rail 12C and the projecting ridge 14*k* is formed at a tip end of the engaging hand 53*b*. Accordingly, the engaging portion 53*c* is engaged with the drooping down wall 14*j* and the projecting ridge 14*k* in a manner such that the engaging portion 53*c* is held by the drooping down wall 14*j* and the projecting ridge 14*k*, and the aforementioned net-holding member 50 is configured to be movable along the guide rail 12C.

In addition, the elongated hole-shaped hooking hole 52*a* and the slit 52*b*, provided in the aforementioned main body portion 52 are the same as that in the aforementioned third embodiment.

Figure 24:
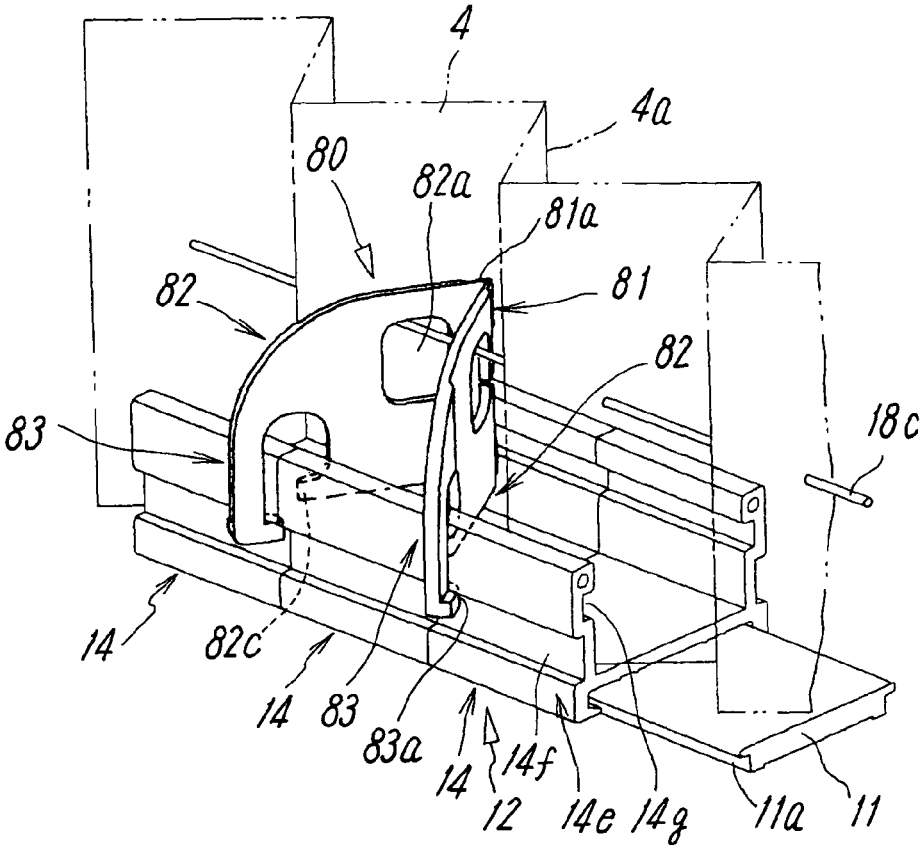
FIG. 24 is a perspective view showing a main part in the seventh embodiment.
Figure 25:
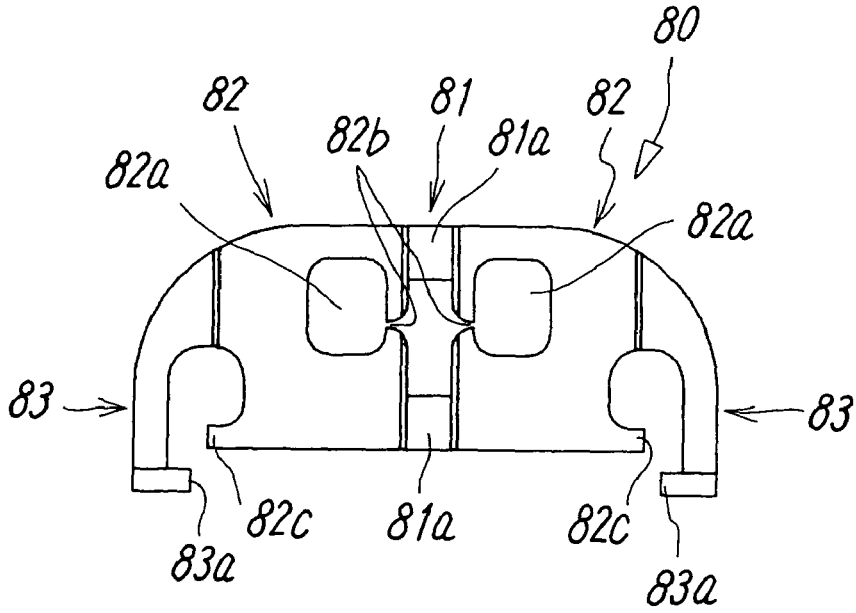
FIG. 25 is a developed elevation showing a net-holding member in the same embodiment.
Figure 26:
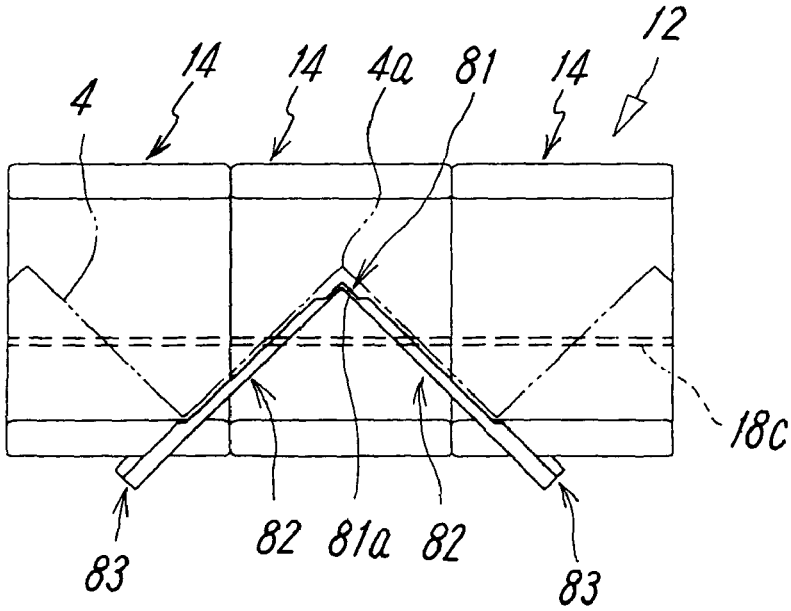
FIG. 26 is a plan view showing a condition of a net-holding member when the net is developed and stretched in the same embodiment.

The fifth embodiment, shown in FIGS. 15 through 19, the sixth embodiment, shown in FIGS. 20 through 23, and the seventh embodiment, shown in FIGS. 24 through 26 are configured such that the net-holding member has independence, namely the net-holding member can be suppressed from slanting either leftward or rightward or the like in response to the open-and-close movement of the net, and suppressed from thereby roughly moving along with the open-and-close operation of the net.

First, the aforementioned fifth embodiment is configured such that the net-holding member 60 is basically provided with two sheets of stretching string hooking pieces 62 that are rotatably connected by a hinge portion 61, which is vertically disposed along a folding line 4*a* of the net 4, and an engaging-and-supporting leg 63 for movably engaging these stretching string hooking pieces 62 with the aforementioned series of guide rails 12A in the net guide 12, explained in the first embodiment. In addition, the aforementioned two sheets of stretching string hooking pieces 62 and the engaging-and-supporting leg 63 to be engaged with the net guide 12 are integrally formed of synthetic resin together with the aforementioned hinge portion 61, and a connecting portion where the two sheets of stretching string hooking pieces 62 that constitute the hinge portion 61 and the engaging-and-supporting leg 63 are connected is rotatably formed in an integral manner by thin-walled portion of the synthetic resin.

The aforementioned two sheets of stretching string hooking pieces 62 connected by means of the aforementioned hinge portion 61 is configured to be able to be opened or closed in a manner so as to follow the plane portions at both sides of the folding lines 4*a* of the net along with expansion and contraction of the net 4. Further, a hooking hole 62*a* for the aforementioned stretching string 18*c* to be inserted is formed in each of the stretching string hooking pieces 62, and a slit 62*b* that reaches an outer edge of the stretching string hooking piece 62 from the hooking hole 62*a* is also formed. The aforementioned stretching string 18*c* is hooked in the aforementioned hooking hole 62*a* through the slit 62*b*. Accordingly, attaching and detaching of the net-holding member 60, namely engaging of the engaging-and-supporting leg 63 of the net-holding member 60 with the series of guide rails 12A of the net guide 12, and insertion of the stretching string 18*c* into the aforementioned hooking hole 62*a* are brought to be easily performed in an assembling condition of the screen door or installed condition thereof.

As described before, although the guide rail 12A of the net guide 12 is formed of a series of concave grooves, 14*f* and 14*g*, provided at each of the outer face and the inner face of the rising wall portion 14*b* of the net guide 12, an engaging portion 62*c* facing the aforementioned concave groove 14*g* is provided at a part of the aforementioned stretching string engaging piece 62, and an engaging portion 63*a* facing the aforementioned concave groove 14*f* is provided at a part of the aforementioned stretching-and-supporting leg 63 so that the aforementioned net-holding member 60 is engaged with these concave grooves, 14*f* and 14*g*. The net-holding member 60 is movably engaged with the aforementioned guide rail 12A by means of engaging the aforementioned both of the concave grooves, 14*f* and 14*g*, with respective engaging portions, 63*a* and 62*a*.

Further, the construction of the guiding element 14 is not different from that in the first embodiment and therefore, the same numerals are marked on the respective portions.

In the sliding screen door having the aforementioned construction, when the net 4 is opened or closed by means of horizontal pulling, the net-holding member 60 is composed of the two sheets of stretching string hooking pieces 62 rotatably connected by the aforementioned hinge portion 61, and the engaging-and-supporting leg 63 that engages with the net guide 12. Since the stretching string hooking pieces 62 are configured to open along the plane portions of both sides of the folding line 4*a* of the net 4 when the net 4 is developed and stretched, a posture of the net-holding member 60 is kept under restraint by at least three points, namely the engaging-and-supporting leg of the net-holding member 60 is kept under restraint by means of the net guide 12, and each of the stretching string hooking pieces 62 is kept under restraint by means of the stretching string 18*c* which is inserted into the hooking holes 62*a* of the stretching string hooking pieces 62. As a result, the net-holding member 60 is suppressed from slanting leftward or rightward in response to the open-and-close movement of the net 4, or is suppressed from rotating around a vertical axis, i.e., around the engaging-and-supporting leg 63 for the net guide 12 as a center. Thereby, the net-holding member 60 can be smoothly moved along the net guide 12.

Figure 19:
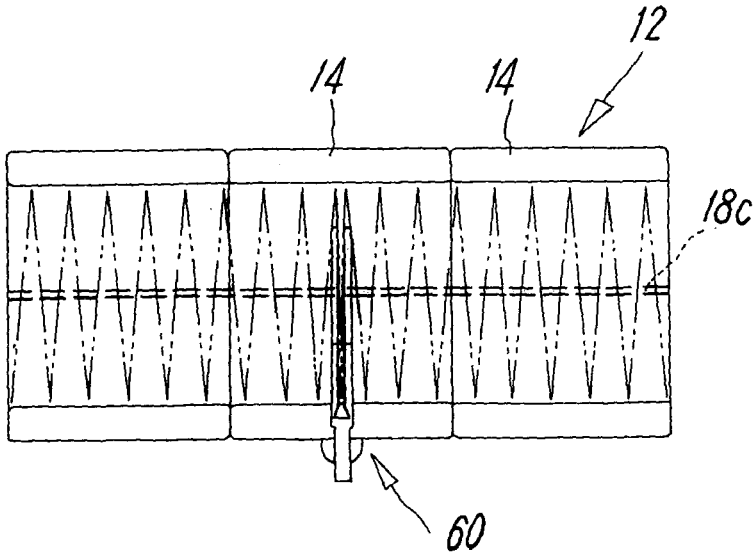
FIG. 19 is a plan view showing a condition of a net-holding member when the net is folded back in the same embodiment.
Figure 20:
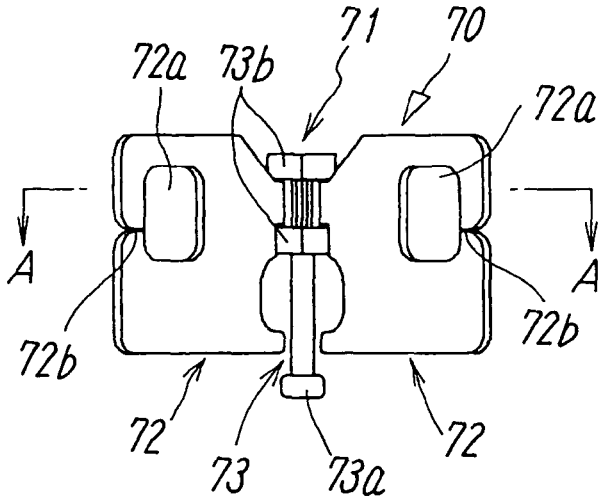
FIG. 20 is a rear elevation showing a net-holding member in the sixth embodiment.
Figure 21:
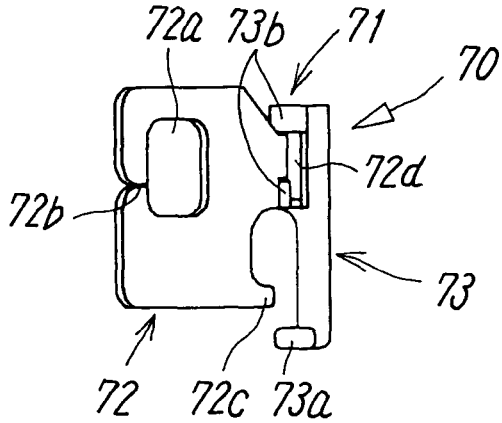
FIG. 21 is a side elevation showing the same.
Figure 22:
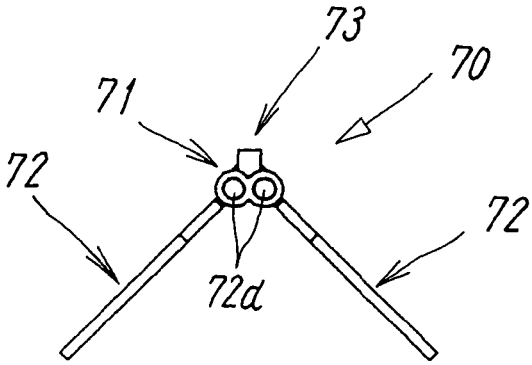
FIG. 22 is a plan view showing the same.
Figure 23:
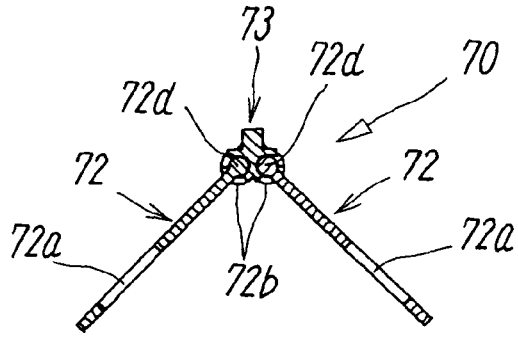
FIG. 23 is a cross-section of A-A line in FIG. 20.

As shown in FIG. 19, when the net 4 is folded back, although the aforementioned two sheets of the stretching string hooking pieces 62 of the net-holding member 60 are folded back with the net 4, there is no space for the net-holding member 60 to change its posture or to move in this condition. Further, since the two sheets of the stretching string hooking pieces 62 are folded back together with the net 4, in a condition to sandwich the net 4, as shown in the figure, there is no possibility such as that housing of the net 4 at a time of folding back has a trouble caused by the existence of the net-holding member 60.

Incidentally, in the sliding screen door of the aforementioned fifth embodiment, although the stretching string 18*c* that constitutes the parallel movement mechanism of the movable doorframe 5 is also utilized to serve as a stretching string to be inserted into the hooking hole 62*a* of the stretching string hooking piece 62, it is not limited to the above described. For example, a stretching string for applying tension force in a direction to fold back the net 4 in the aforementioned movable doorframe 5, such as a spring can be also utilized.

Further, in the aforementioned embodiment, as s screen door 1, a case is explained, in which a net guide 12 that is led out from and led into the frame member is constructed without providing a fixed frame member at the lower part, intending to form a barrier-free construction. However, it is natural to say that a fixed frame member to an extent of the aforementioned guide plate 11 can be provided without inconvenience.

Furthermore, when the aforementioned net-holding member 60 is movably engaged with the net guide 12, a device to be engaged with the net guide 12 can be provided in the engaging-and-supporting leg 63, as described in the third embodiment or the fourth embodiment without providing an engaging portion 62*c*, or the like at a part of the stretching string hooking piece 62. The same is true of the sixth embodiment explained hereinafter.

Next, a net-holding member 70 in the sixth embodiment will be explained referring to FIGS. 20 through 23.

The net-holding member 70 in the sixth embodiment is provided with two sheets of stretching string hooking pieces 72 being movably connected by a hinge 71 that is vertically disposed along the folding line 4*a* of the net 4, and being configured to open and close in a manner so as to follow plane portions at both sides of the aforementioned folding line 4*a* along with expansion and contraction of the net 4, similarly to that in the aforementioned fifth embodiment. A hooking hole 72*a* where the aforementioned stretching string 18*c* is inserted is formed at each of the stretching string hooking pieces 72 of the net-holding member 70, and an engaging-and-supporting leg 73 to be movably engaged with the aforementioned net guide 12 is provided in the net-holding member 70. However, in comparison with the net-holding member 60 in the aforementioned fifth embodiment, the construction of the hinge portion 71 is different.

The hinge portion 71 of the aforementioned net-holding member 70 is configured such that rotating shaft portions 72*d* are respectively formed at a connecting portion of the two sheets of stretching string hooking pieces 72, and that a pair of rotatably supporting portions 73*b*, which is partially opened, for rotatably supporting the aforementioned rotating shaft portion 72*d* is provided in the engaging-and-supporting leg 73, which is movably engaged with the net guide 12. In addition, the hinge portion 71 is configured such that the rotating shaft portions 72*d* are pressed into the rotatably supporting portions 73*b* and are rotatably supported.

Further, the numeral 72*b* in the figure denotes a slit for passing the stretching string 18*c* into the hooking hole 72*a*, numerals, 72*c* and 73*a*, respectively denote the engaging portions.

The construction of engaging the engaging-and-supporting leg 73 of the net-holding member 70 with the net guide 12 in the sixth embodiment and operation of the net-holding member 70 in the sixth embodiment are not substantially different form that in the aforementioned fifth embodiment and explanation for the same is thereby omitted.

Next, a net-holding member 80 in the seventh embodiment of the present invention will be explained referring to FIGS. 24 through 26.

The net-supporting member 80 of the seventh embodiment is rotatably connected by a hinge portion 81 being vertically disposed along the folding line 4*a* of the net 4, and is provided with two sheets of stretching string hooking pieces 82 that open and close in a manner so as to follow the plane portions at both sides of the folding line 4*a* along with the expansion and contraction of the net 4. Further, a hooking hole 82*a* for the aforementioned stretching string 18*c* to be inserted is provided at each of the stretching string hooking pieces 82. However, the hooking-and-supporting leg is not provided at the hinge portion side as described in the aforementioned fifth and sixth embodiments. Connecting portions of the two sheets of the stretching string hooking pieces 82 formed of synthetic resin are integrally formed in a rotatable manner by means of a thin-walled portion 81*a* formed of the synthetic resin at the aforementioned hinge portion 81, and engaging-and-supporting legs 83 that are movably engaged with the net guide 12 are integrally provided at a facing edge side opposite to the hinge portion 81 at each of the stretching string hooking pieces 82.

Further, a slit 82*b* of the hooking hole 82*a* of the aforementioned stretching string hooking piece 82 for the stretching string 18*c* to be passed through is provided between the upper part and the lower part of the aforementioned thin-walled portion 81*a* after separating the same into the upper part and the lower part.

Furthermore, in order to engage the aforementioned net-holding member 80 with guide rail 12A of the net guide 12 described above, an engaging portion 83*a* that is engaged with the concave groove 14*f* provided at the outer face of the net guide 12 is provided at a portion, which is facing the aforementioned concave groove 14*f*, of each of the engaging-and-supporting legs 83, and an engaging portion 82*c* that is engaged with the concave groove 14*g* provided at the inner face of the net guide 12 is provided at a portion, which is facing the aforementioned concave groove 14*g*, of each of the stretching string hooking pieces 82. Thereby, the net-holding member 80 is configured to be movably engaged with the aforementioned guide rail 12A.

Incidentally, the construction of the guiding element 14 is not different form that in the first embodiment and therefore, the same numerals are marked on the respective portions.

In the seventh embodiment, as is clear from FIGS. 24 through 26, in a condition in which the engaging portion 83*a* of the engaging-and-supporting leg 83 and the engaging portion 82*c* of the stretching string hooking piece 82 are engaged with the guiding rail 12A of the net guide 12, the net-holding member 80 is positioned at an inner face side of the valley fold portion of the net 4 being bent at the folding line 4*a*, and the stretching string hooking pieces 82, which are rotatably constructed by the hinge portion 81, being vertically disposed along the folding line 4*a* of the net 4, are disposed along inner faces of the plane portions at both sides of the folding line 4*a* of the net 4. As a result, at a time when the net 4 is folded back, the two sheets of the stretching string hooking pieces 82 are configured to be sandwiched between the plane portions of both sides of the folding line 4*a* of the net 4.

On the other hand, the net-holding members, 60 and 70, in the aforementioned fifth and sixth embodiments, respectively, are positioned at an out side of the mountain fold portion of the net 4, and the stretching string hooking pieces, 62 and 72, which are rotatable by the hinges, 61 and 71, are disposed along outer surfaces of the plane portions at both sides of the aforementioned folding line 4*a*. As a result, at a time when the net 4 is folded back, the net being folded at the folding line 4*a* is configured to be sandwiched by means of the two sheets of the stretching string hooking pieces.

Further, in the net-holding member 80 of the seventh embodiment at a time of opening-and-closing movement due to the horizontal pulling of the net 4, and in a condition of that the engaging-and-supporting leg 83 or the like is movably engaged with the net guide 12, and the stretching string 18*c* inserted into the lower portion of the net 4 is inserted into the hooking hole 82*a* of the two sheets of stretching string hooking pieces 82, the posture of the net-holding member 80 is kept under restraint at four points. In other words, a pair of the engaging-and-supporting legs 83 provided in each of the stretching string hooking pieces 82 of the net-holding member 80 is respectively kept under restraint by the net guide 12, and each of the stretching string hooking pieces 82 is kept under restraint by the stretching string 18*c* inserted into the hooking holes 82*a* thereof. As a result, the net-holding member 80 is suppressed from slanting leftward and rightward in response to the open-and-close movement of the net 4 and is able to be smoothly moved along the net guide 12.

Figure 27:
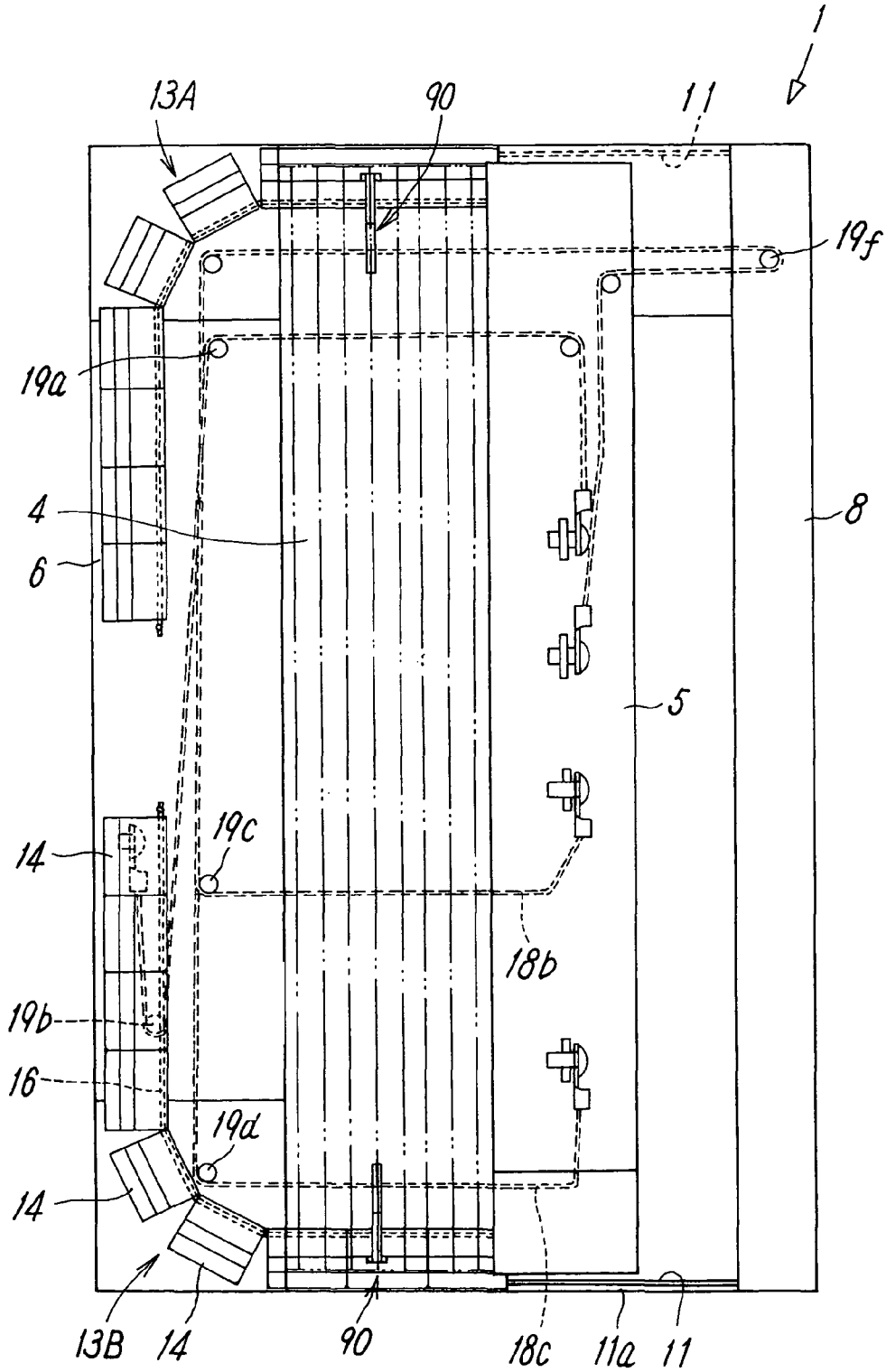
FIG. 27 is an elevation of a frame showing a schematic of the eighth embodiment where a net guide is provided at upper and lower screen door frames.

In the description above, the embodiments in which the net guide is provided only at the lower portion of the screen-door frame 1, and the net 4 is held by means of the net guide, is explained. However, as shown in FIG. 27, by providing net guides, 13A and 13B, at an upper and the lower portions of the screen door frame 1, the net-holding member 90 can be also engaged between either one of the net guides 13A and 13B, and the stretching string 18*c* being inserted into the upper and lower end portions of the net. Further, fixing one end of the net guides, 13A and 13B, to a lower end of the vertical frame member 6, the other end thereof can be also moved in and out from the lower end of the movable frame member composed of the movable doorframe 5. Furthermore, on the main portion to be common to that in the aforementioned first embodiment, the same numerals in the first embodiment are marked, and the explanations therefor are omitted.

Moreover, in the explanation described above, although various net guides, various guiding elements and net-holding members that can be used in the present invention are explained, the present invention is not limited to that shown in those embodiments and modifications of the design can be appropriately made without departing from the spirit of the appended claims.

The invention claimed is:

1. A sliding screen door, comprising:

a net being alternately folded back in a reverse direction at folding lines parallel to each other, the net is configured to expand and contract by being folded back at the folding lines, and configured to be capable of open-and-close movement by horizontal pulling;

a frame member; and a net guide moving out from and into an interior of at least one end of the frame member attached to both ends in an open-and-close direction of the net, in response to the open-and-close movement of the net, and guiding an upper and lower end or one end of the net, wherein the net guide is configured to mutually and flexibly connect a plurality of guiding elements formed of an approximately U-shape composed of a bottom portion following an end portion of the net and a pair of rising wall portions rising from the bottom portion configured to follow faces of the net, wherein at least one of the pair of rising wall portions of the guiding element has, on an inner wall face thereof, an inner rail concave groove extending in a longitudinal direction of the net guide and has, on an outer wall face thereof, an outer rail concave groove extending in a longitudinal direction of the net guide, and to form a series of guide rails formed by making the inner rail concave groove and outer rail concave groove serially in contact with each other at each of the outer wall face and the inner wall face of the rising wall portion of the net guide between adjoining guiding elements, wherein the concave grooves formed on each of the outer and inner faces of the rising wall portion of the net guide are formed at the rising wall portion at locations having a different height, such that the concave groove formed on the inner face of the rising wall portion is formed so as to be more adjacent to a tip end of the rising wall portion compared to the concave groove formed on the outer face of the rising wall portion, wherein the guiding elements are serially in contact with each other at the rising wall portions of the adjoining guiding elements when the net guide is led out along the end portion of the net being stretched so that the inner rail concave groove and outer rail concave groove are in contact with each other at a same height between adjoining guiding elements, and wherein the guide rail of the net guide is provided with a net-holding member for suppressing the end portion of the net to be disengaged from the net guide by directly or indirectly holding the end portion of the net, the net-holding member has a first engaging portion arranged on a side of the inner wall face of the rising wall portion and a second engaging portion arranged on a side of the outer wall face of the rising wall portion, the first engaging portion of the net-holding member engages with the inner rail concave groove of the guide rail, and the second engaging portion engages with the outer rail concave groove of the guide rail, such that the net-holding member is configured to be movable along the guide rail by engaging both of the inner rail concave groove and outer rail concave groove, and wherein each of the rising wall portions of the guiding elements includes the inner wall face facing a side of the face of the net and the outer wall face facing opposite side to the inner wall face, and the net-holding member is disposed across the outer and inner wall faces of the rising wall portion of the guiding element while the net-holding member is hung on a tip end of the rising wall portion facing in a rising direction, in which the rising wall portion rises, and is engaged with the guide rail in a manner so as to be movable along the guide rail, and wherein a thickness the first engaging portion in a rising direction of the rising wall portion is smaller than a width of the inner rail concave groove in the rising direction, and wherein a thickness of the second engaging portion in a rising direction of the rising wall portion is smaller than a width of the outer rail concave groove in the rising direction.

2. The sliding screen door according to claim 1, wherein an engaging portion of the net-holding member is formed in a shape of a disk, and wherein the net-holding member is engaged with the rising wall portion of the guiding element in a manner so as to be rotatable in response to a direction of the net keeping a vertical posture.

3. The sliding screen door according to claim 1, wherein a stretching string constituting a parallel movement mechanism for moving a movable doorframe provided for open-and-close operation for the net, in parallel is inserted into the net and stretched within the frame member constituting the sliding screen door, and wherein the net-holding member provided in the net guide is configured to have a hooking hole for hooking the stretching string, and the lower end of the net is indirectly held by hooking the stretching string stretched at a lower part within the frame member with the hooking hole.

4. The sliding screen door according to claim 3, wherein the hooking hole for inserting the stretching string in the net-holding member comprises a slit reaching an outer edge of the net-holding member, and the stretching string is hooked to the hooking hole through the slit.

5. The sliding screen door according to claim 1, wherein the net guide is configured to mutually and flexibly connect many of the guiding elements by inserting a series of wire members into a through hole following the tip end of the rising wall portion of the guiding elements, wherein an expansion portion expanding to the inner face side is formed at the tip end of the rising wall portion, and wherein the inner face-side concave groove of the rising wall is formed adjacently to the expansion portion.

* * * * *